US010693240B2

(12) United States Patent
Ding et al.

(10) Patent No.: US 10,693,240 B2
(45) Date of Patent: Jun. 23, 2020

(54) ANTENNA AND COMMUNICATIONS DEVICE

(71) Applicant: HUAWEI TECHNOLOGIES CO., LTD., Shenzhen (CN)

(72) Inventors: Feng Ding, Suzhou (CN); Kun Zhang, Suzhou (CN); Xiaoxin Chen, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 138 days.

(21) Appl. No.: 15/898,059

(22) Filed: Feb. 15, 2018

(65) Prior Publication Data

US 2018/0248270 A1 Aug. 30, 2018

(30) Foreign Application Priority Data

Feb. 28, 2017 (CN) ..... 2017 1 0111992

(51) Int. Cl.
*H01Q 1/50* (2006.01)
*H01Q 21/00* (2006.01)
(Continued)

(52) U.S. Cl.
CPC ..... *H01Q 21/0075* (2013.01); *H01Q 1/48* (2013.01); *H01Q 9/045* (2013.01); *H01Q 9/0407* (2013.01);
(Continued)

(58) Field of Classification Search
CPC ..... H01Q 1/48; H01Q 9/045; H01Q 21/0087; H01Q 21/061
See application file for complete search history.

(56) References Cited

U.S. PATENT DOCUMENTS 7,205,865 B2 4/2007 Kang et al.
8,674,746 B1 3/2014 Staudinger
(Continued)

FOREIGN PATENT DOCUMENTS

CN 101552380 A 10/2009
CN 101719594 A 6/2010
(Continued)

OTHER PUBLICATIONS

Machine Translation and Abstract of Japanese Publication No. JPH0832395, Mar. 29, 1996, 9 pages.
(Continued)

*Primary Examiner* — Dieu Hien T Duong
(74) *Attorney, Agent, or Firm* — Conley Rose, P.C.

(57) ABSTRACT

An antenna and a communications device are disclosed. The antenna includes: multiple feeders, a microstrip antenna array, and at least one energy attenuation circuit; the microstrip antenna array includes multiple array elements, where each of the multiple array elements is connected to a cable feeding port by using one of the multiple feeders; each of the at least one energy attenuation circuit is located at a feeder, where the feeder is one of the multiple feeders and is connected to an array element, and the array element is located at a periphery of the multiple array elements; and the energy attenuation circuit includes a resistor, where the resistor is grounded, and the resistor consumes a part of energy in the feeder when the resistor is grounded.

23 Claims, 7 Drawing Sheets

(51) Int. Cl.

| | |
|---|---|
| ***H01Q 9/04*** | (2006.01) |
| ***H01Q 1/48*** | (2006.01) |
| ***H01Q 21/06*** | (2006.01) |
| ***H01Q 21/22*** | (2006.01) |

(52) U.S. Cl.
CPC ..... *H01Q 21/0087* (2013.01); *H01Q 21/061* (2013.01); *H01Q 21/065* (2013.01); *H01Q 21/22* (2013.01)

(56) References Cited

U.S. PATENT DOCUMENTS

| | | | | |
|---|---|---|---|---|
| 2007/0046393 | A1* | 3/2007 | Quan | H01P 5/16 333/128 |
| 2008/0211720 | A1 | 9/2008 | Hansen | |
| 2009/0009399 | A1* | 1/2009 | Gaucher | H01Q 21/0006 343/700 MS |
| 2013/0063297 | A1 | 3/2013 | Papziner et al. | |
| 2016/0197405 | A1* | 7/2016 | Higaki | H01Q 21/065 343/852 |

FOREIGN PATENT DOCUMENTS

| | | | | |
|---|---|---|---|---|
| CN | 101763498 | A | * | 6/2010 |
| CN | 102893451 | A | | 1/2013 |
| CN | 103384022 | A | | 11/2013 |
| CN | 103700917 | A | | 4/2014 |
| DE | 102010020022 | A1 | | 11/2011 |
| JP | H0832395 | B2 | | 3/1996 |
| JP | 2014082755 | A | | 5/2014 |
| WO | 2010004992 | A1 | | 1/2010 |

OTHER PUBLICATIONS

Foreign Communication From a Counterpart Application, Japanese Application No. 2018-033767, Japanese Office Action dated Mar. 19, 2019, 3 pages.
Foreign Communication From a Counterpart Application, Japanese Application No. 2018-033767, English Translation of Japanese Office Action dated Mar. 19, 2019, 3 pages.
Machine Translation and Abstract of Chinese Publication No. CN103384022, Nov. 6, 2013, 12 pages.
Machine Translation and Abstract of Chinese Publication No. CN103700917, Apr. 2, 2014, 17 pages.
Machine Translation and Abstract of German Publication No. DE102010020022, Nov. 10, 2011, 16 pages.
Foreign Communication From a Counterpart Application, European Application No. 18156669.6, Extended European Search Report dated Jul. 13, 2018, 9 pages.
Machine Translation and Abstract of Chinese Publication No. CN101552380, Oct. 7, 2009, 13 pages.
Machine Translation and Abstract of Chinese Publication No. CN101719594, Jun. 2, 2010, 14 pages.
Machine Translation and Abstract of Chinese Publication No. CN102893451, Jan. 23, 2013, 13 pages.
Machine Translation and Abstract of International Publication No. WO2010004992, Jan. 14, 2010, 54 pages.
Foreign Communication From a Counterpart Application, Chinese Application No. 201710111992.9, Chinese Office Action dated Aug. 28, 2019, 6 pages.

* cited by examiner

ANTENNA AND COMMUNICATIONS DEVICE

CROSS-REFERENCE TO RELATED APPLICATION

This application claims priority to Chinese Patent Application No. 201710111992.9, filed on Feb. 28, 2017, which is hereby incorporated by reference in its entirety.

TECHNICAL FIELD

This disclosure relates to the field of microstrip antenna technologies, and in particular, to an antenna and a communications device.

BACKGROUND

A microstrip antenna is an antenna fabricated on a printed circuit board by using a microstrip technology. A common microstrip antenna is formed by a thin dielectric substrate, for example, a polytetrafluorethylene fiberglass layer, with metal foil attached on one surface as a ground plane, and with a metal patch of a specific shape that is made by using a method such as photoetching on the other surface as an antenna.

SUMMARY

This disclosure provides an antenna and a communications device, and a method of making an antenna.

According to a first aspect, an antenna is provided. The antenna may include: multiple feeders, a microstrip antenna array, and at least one energy attenuation circuit. The microstrip antenna array may include multiple array elements, where each of the multiple array elements is connected to a cable feeding port by using one of the multiple feeders; each of the at least one energy attenuation circuit may be located at a feeder and divides the feeder into two segments, where the feeder is one of the multiple feeders and is connected to an array element, and the array element is located at a periphery of the multiple array elements.

The antenna may also include a first end of the energy attenuation circuit that is connected to the cable feeding port by using one segment of the feeder, a second end of the energy attenuation circuit that is connected to the array element by using the other segment of the feeder, and a third end of the energy attenuation circuit that is grounded. The energy attenuation circuit may include a resistor, where the resistor is grounded, and the resistor is configured to consume a part of energy in the to-be attenuated feeder when the resistor is grounded.

According to a second aspect, a communications device is provided. The communications device may include an antenna, and a signal source; the signal source may be connected to a feeding port of the antenna; and the signal source is configured to use the antenna to send and receive a radio signal.

The antenna of the communications device may include: multiple feeders, a microstrip antenna array, and at least one energy attenuation circuit. The microstrip antenna array may include multiple array elements, where each of the multiple array elements is connected to a cable feeding port by using one of the multiple feeders; each of the at least one energy attenuation circuit may be located at a feeder and divides the feeder into two segments, where the feeder is one of the multiple feeders and is connected to an array element, and the array element is located at a periphery of the multiple array elements.

The antenna may also include a first end of the energy attenuation circuit that is connected to the cable feeding port by using one segment of the feeder, a second end of the energy attenuation circuit that is connected to the array element by using the other segment of the feeder, and a third end of the energy attenuation circuit that is grounded. The energy attenuation circuit may include a resistor, where the resistor is grounded, and the resistor is configured to consume a part of energy in the to-be attenuated feeder when the resistor is grounded.

According to a third aspect, a method of making an antenna is provided. The method may include forming a microstrip antenna array that may include multiple array elements, where each of the multiple array elements is connected to a cable feeding port by using one of multiple feeders; providing at least one energy attenuation circuit, where each of the at least one energy attenuation circuit is located at a feeder and divides the feeder into two segments, where the feeder is one of the multiple feeders and is connected to an array element, and the array element is located at a periphery of the multiple array elements; providing a first end of the energy attenuation circuit that is connected to the cable feeding port by using one segment of the feeder, providing a second end of the energy attenuation circuit that is connected to the array element by using the other segment of the feeder, and providing a third end of the energy attenuation circuit that is grounded; and providing a resistor that is comprised in the energy attenuation circuit, where the resistor is grounded, and consuming a part of energy in the feeder by the resistor when the resistor is grounded.

It is to be understood that both the forgoing general description and the following detailed description are exemplary and illustrative only, and are not restrictive of the present disclosure.

BRIEF DESCRIPTION OF DRAWINGS

The drawings are incorporated in, and formed a part of, the specification to show examples in conformity with the disclosure, and are for the purpose of illustrating the principles of the disclosure along with the specification.

DETAILED DESCRIPTION

Figure 1:
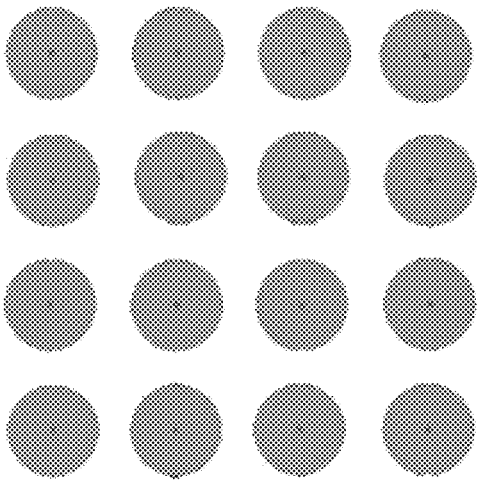
FIG. 1 is a schematic diagram of a 4*4 uniform array antenna.

A microstrip array antenna is a two-dimensional array that includes multiple patch antennas. FIG. 1 illustrates a 4*4 microstrip antenna array.

The antenna array shown in FIG. 1 is a uniform array, that is, antenna elements are arranged with a uniform spacing, and distances between any two adjacent antenna elements are equal. In addition, feeders are also symmetrically designed with a uniform wiring.

This uniform array antenna may implement balanced energy distribution between array elements, or may implement unbalanced energy distribution. When energy distribution between the array elements is balanced, wiring of feeders of this antenna is simple and clear. However, this antenna with balanced energy distribution has a low side lobe suppression (SLS) ratio, and is difficult to meet a design requirement.

An example of this disclosure provides an antenna. An energy attenuation circuit is added based on an original antenna, and the energy attenuation circuit is configured to attenuate energy of a peripheral array element of a microstrip antenna array, thereby increasing a side lobe suppression ratio of the antenna, and improving an effect of the antenna.

Figure 2:
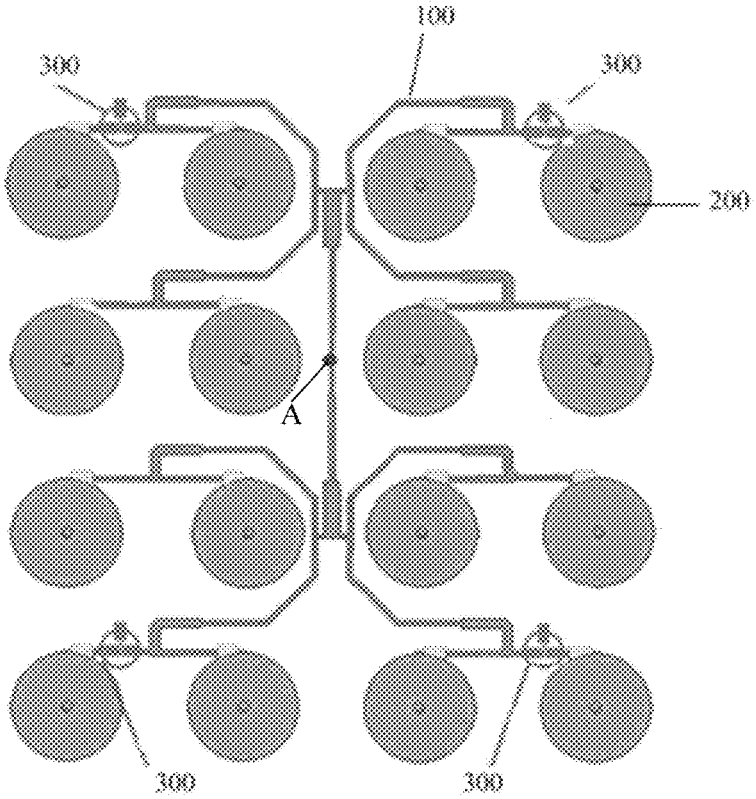
FIG. 2 is a schematic diagram of an antenna according to an example of this disclosure.

Referring to FIG. 2, this figure is a schematic diagram of an antenna according to an example of this disclosure.

The antenna provided in this example includes: multiple feeders 100, a microstrip antenna array, and at least one energy attenuation circuit 300. The microstrip antenna array includes multiple array elements 200, and each of the multiple array elements 200 is connected to a cable feeding port A by using one of the multiple feeders. The cable feeding port A is an interface connecting the antenna and a signal source. A radio signal sent by the signal source is transmitted to the antenna by using the interface, and a radio signal received by the antenna is transmitted to the signal source by using the interface. The microstrip antenna array is an array formed by the array elements 200, and the array elements 200 are patches in the antenna.

The microstrip antenna array in the antenna provided in this example of this disclosure may be N*1 or N*M, where both N and M are integers greater than or equal to 2, and N may be equal to M, or may not be equal to M.

In this example, the microstrip antenna array shown in FIG. 2 is N*M, where N=M=4, that is, there are four rows by four columns of array elements. N and M may also be other values, and values of N and M are not specifically limited in this example. However, one of N or M is greater than or equal to 3, and the other is greater than or equal to 2. For example, if N=2, and M=3, there is a corresponding 2*3 array. However, M and N cannot both be 2. When both N and M are 2, there is a corresponding 2*2 array. For the 2*2 array, a peripheral array element of the array is also a central array element, and changing energy distribution between the array elements is meaningless. Therefore, at least one of M or N needs to be greater than or equal to 3.

Each of the at least one energy attenuation circuit is located at a to-be-attenuated feeder and divides the to-be-attenuated feeder into two segments, the to-be-attenuated feeder is a feeder that is of the multiple feeders and that is connected to a to-be-attenuated array element, and the to-be-attenuated array element is an array element located at a periphery of the multiple array elements.

As shown in FIG. 2, a first end of the energy attenuation circuit 300 is connected to the cable feeding port A by using one segment of the to-be-attenuated feeder, a second end of the energy attenuation circuit 300 is connected to the to-be-attenuated array element by using the other segment of the to-be-attenuated feeder, and a third end of the energy attenuation circuit 300 is grounded.

The energy attenuation circuit 300 is inserted into an entrance feeder of the array element 200. An entrance feeder of an array element means that this feeder is connected only to the array element. That is, the entrance feeder is a branch feeder corresponding to the array element, and another array element does not share this branch feeder. If at least two to-be-attenuated array elements share one branch feeder, and array elements other than these array elements do not share the branch feeder, this branch feeder is an entrance feeder of these array elements. That is, the energy attenuation circuit in this example of this disclosure is inserted into an entrance feeder of an array element that requires energy attenuation. The energy attenuation circuit 300 is not connected to the entrance feeder in parallel. A feeder connected to the to-be-attenuated array element is cut off, and the energy attenuation circuit is inserted. The cut-off feeder includes two ends. A first end and a second end of the energy attenuation circuit are respectively connected to the two ends of the cut-off feeder, and a third end of the energy attenuation circuit is grounded.

The energy attenuation circuit 300 includes a resistor, the resistor is grounded, and the resistor is configured to consume a part of energy in the to-be attenuated feeder in a grounded manner.

When a current passes through the resistor, electrical energy can be converted into thermal energy, and the thermal energy can be consumed in the grounded manner, so that energy that enters the to-be-attenuated array element can be attenuated.

Figure 3:
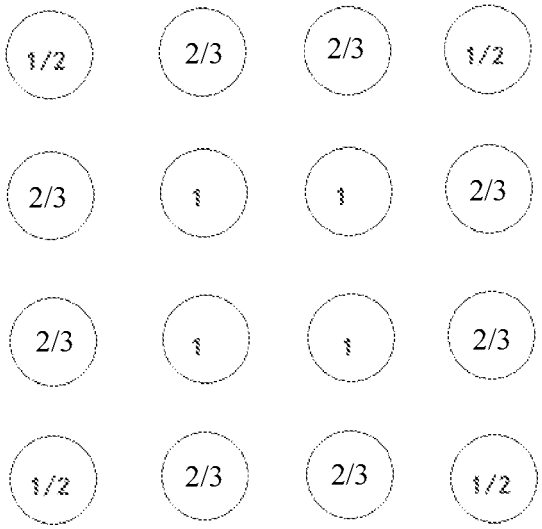
FIG. 3 is a schematic diagram of another antenna according to an example of this disclosure.

A specific location of an array element at a periphery of an array is not limited in this example. Schematically, FIG. 2 merely shows that energy attenuation units are inserted into entrance feeders of array elements at four corners of the 4*4 array. An energy attenuation unit may further be inserted into an entrance feeder of another array element at the periphery of the array according to a requirement. For example, as shown in FIG. 3, the 4*4 array is still used as an example for description. Energy of the four corners is attenuated to ½ of the original, and energy of peripheral array elements at locations except the four corners is attenuated to ⅔ of the original. This can also correspondingly increase a side lobe suppression ratio. However, due to limitations of a technology and a spatial layout, attenuating the energy of the array elements located at the four corners is the most effective and simplest implementation. Energy distribution of the antenna after energy attenuation obeys a rule that energy of the array elements is gradually reduced from a central area to a peripheral area.

Figure 4:
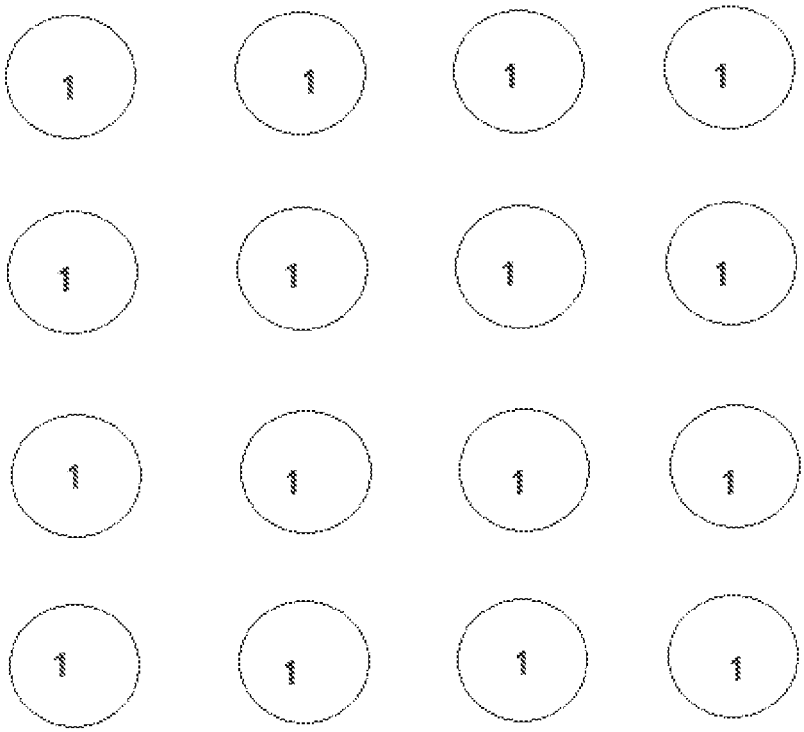
FIG. 4 is a schematic diagram of an antenna array without energy attenuation according to an example of this disclosure.
Figure 5:
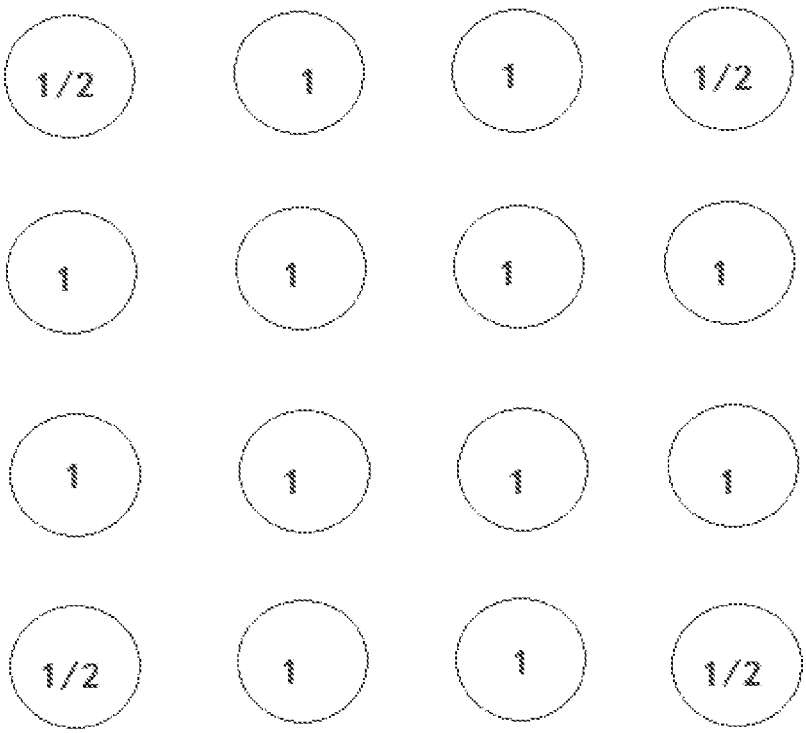
FIG. 5 is a schematic diagram of an antenna array after energy attenuation according to an example of this disclosure.

To enable a person skilled in the art to better understand technical solutions in this example of this disclosure, the following still uses the 4*4 array as an example for description with reference to FIG. 4 and FIG. 5. FIG. 4 is a schematic diagram of a microstrip patch array before energy attenuation, and FIG. 5 is a schematic diagram of a microstrip patch array after energy attenuation.

Distances between any two adjacent array elements in the microstrip patch array shown in FIG. 4 are equal, and energy distribution is balanced, that is, an energy ratio between each array element is 1:1. However, a side lobe suppression ratio corresponding to such balanced energy distribution is relatively low, and cannot meet a requirement. To increase the side lobe suppression ratio of the microstrip patch antenna, energy of a peripheral array element in the microstrip patch array is attenuated in this example of this disclosure.

As shown in FIG. 5, energy of the array elements located at the four corners of the microstrip patch array is attenuated to ½ of the original. According to the microstrip patch antenna provided in this example, the energy attenuation circuit can be directly inserted based on the original antenna. In this way, new feeders do not need to be designed, thereby reducing design difficulty and shortening a development cycle.

Figure 6:
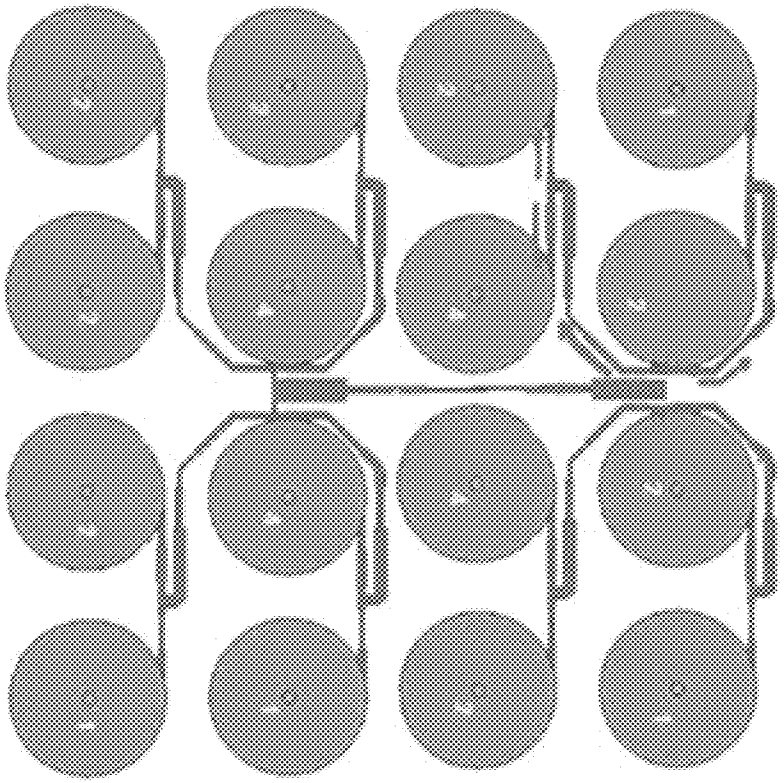
FIG. 6 is a schematic diagram of increasing a side lobe suppression ratio by changing an impedance of a feeder.

To enable a person skilled in the art to better understand beneficial effects brought by the examples of this disclosure, the following first describes a non-uniform design manner of increasing a side lobe suppression ratio of a microstrip patch antenna. Referring to FIG. 6, this figure is a schematic diagram of increasing a side lobe suppression ratio by changing an impedance of a feeder.

Because energy of an array element is related to a resistance of a feeder corresponding to the array element, the energy distributed to the array element may be changed by changing a resistance of the feeder. In addition, the resistance is decided by a length and a thickness of the feeder. Therefore, to change the resistance of the feeder, a shape of the feeder needs to be changed, that is, the feeder needs to be redesigned. As shown in FIG. 6, energy distributed to an array element may be changed by changing a resistance of a feeder corresponding to the array element. It can be learned that, in FIG. 6, energy of four array elements in the center is 4; energy of an array element at the top left corner, an array element at a top right corner, and two array elements at the bottom right corner in the last column is 1; and energy of remaining array elements is 2. In this way, an array element energy ratio of 4:2:1 can be implemented. An advantage of an antenna with a non-uniform design is that total energy is distributed between microstrip antennas. Therefore, a power loss is low.

However, a design of such unbalanced energy distribution in FIG. 6 is relatively difficult, and a development cycle is relatively long. In addition, although the designed ratio is theoretically 4:2:1, due to coupling between branches during actual operation, energy is not distributed between array elements in an actual product according to the designed ratio. As a result, an antenna design failure is caused.

The antenna provided in this example of this disclosure is an improvement made based on balanced energy distribution between array elements. An original feeder wiring design is reserved, and unbalanced energy distribution between the array elements is implemented by inserting an energy attenuation circuit, thereby increasing the side lobe suppression ratio.

Figure 7:
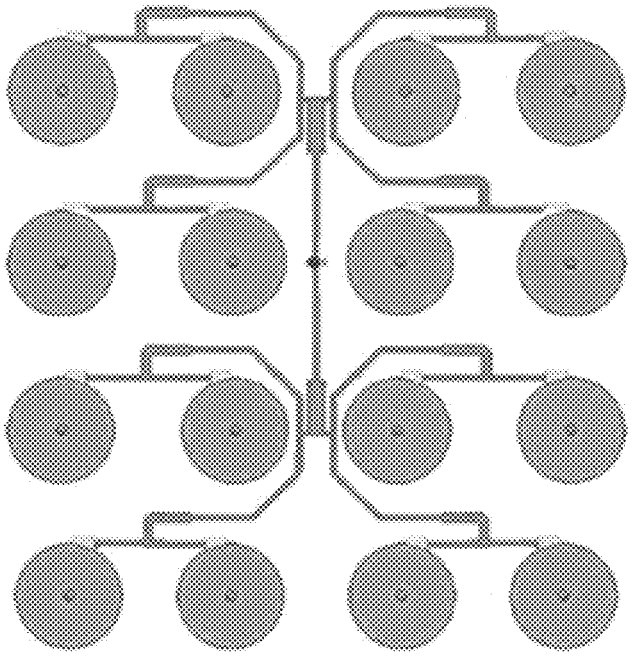
FIG. 7 is a schematic diagram corresponding to balanced energy distribution between array elements.

As shown in FIG. 7, feeders corresponding to balanced energy distribution between array elements are highly concise and clear. That is, FIG. 7 provided in this example of this disclosure is based on FIG. 1, and energy attenuation circuits are inserted, to attenuate energy of the array elements at the four corners. Although the inserted energy attenuation circuits cause a loss to signal power from the cable feeding port, the side lobe suppression ratio is increased. In this way, an improvement is made based on the original feeders with unchanged energy distribution. Therefore, a design is simple and a development cycle is short. For example, an antenna is made of a metal material and includes a 4*4 microstrip antenna array whose operating frequency is 2.4 GHz (GHz), and both horizontal and vertical distances between array elements are 64 mm. If no energy attenuation circuit is inserted, a side lobe suppression ratio is 9.13 dB (dB) during actual operation of the antenna. If the design in this example of this disclosure is used, the side lobe suppression ratio during actual operation of the antenna reaches 11.76 dB, that is, increases by 2.63 dB. The side lobe suppression ratio of 11.76 dB meets a requirement that a side lobe suppression ratio is at least 10 dB.

The antenna is an improvement made based on the balanced energy distribution between the array elements in the original antenna, and the energy attenuation circuit is inserted into the feeder connected to the array element located at a periphery of the antenna array. The energy attenuation circuit includes a resistor, one end of the energy attenuation circuit is grounded, and energy is consumed as heat in a grounded manner. Therefore, the original array elements with balanced energy distribution change to array elements with unbalanced energy distribution. In this way, the side lobe suppression ratio can be increased. The side lobe suppression ratio of the antenna can be increased by directly inserting the energy attenuation circuit based on the original antenna. In this way, new feeders do not need to be designed, thereby reducing design difficulty.

The antenna provided in this example of this disclosure is not limited to a specific antenna type, and may be a uniform array, or may be an equi-amplitude array. "Uniform array" and "balanced energy distribution between array elements" are different concepts, that is, array elements in a uniform array may have balanced energy distribution, or may have unbalanced energy distribution.

The following describes an insertion location of the energy attenuation circuit and an implementation in detail with reference to the accompanying drawings.

Figure 8:
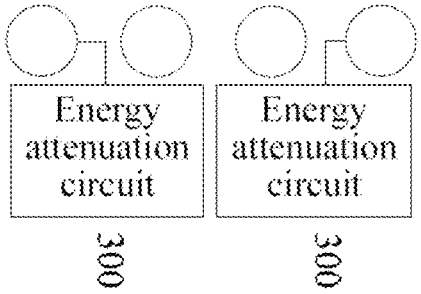
FIG. 8 is a schematic diagram of a 4*1 microstrip patch antenna according to an example of this disclosure.

The multiple array elements are arranged into an N*1 array, peripheral array elements of the multiple array elements are two array elements located at ends of the N*1 array, and each of the two array elements corresponds to one of the at least one energy attenuation circuit, where N is an integer greater than or equal to 3. The following uses a 4*1 array as an example for description. Referring to FIG. 8, this figure is a schematic diagram of a 4*1 antenna according to an example of this disclosure.

That is, energy attenuation circuits are inserted into feeders connected to two array elements at ends, and energy on the feeders is attenuated, so as to attenuate energy that enters the array elements at the two ends.

The multiple array elements are arranged into an N*M array, peripheral array elements of the multiple array elements are four array elements located at corners of the N*M array, and each of the four array elements corresponds to one of the at least one energy attenuation circuit, where both N and M are integers greater than or equal to 2, and N may be equal to M, or may not be equal to M. For an N*N array, refer to the schematic diagram shown in FIG. 2 in which N=4. Likewise, an N*M array is similar to FIG. 2, and an only difference is that row array elements are different from column array elements.

When N is not equal to M, for example, when N=4, and M=6, there is a corresponding 4*6 array.

A function of the energy attenuation circuit is merely energy attenuation, and it needs to be ensured that neither signal reflection nor a standing wave exists in the antenna when the energy attenuation circuit is inserted. Therefore, both an input equivalent impedance and an output equivalent impedance of the energy attenuation circuit are required to be equal to a characteristic impedance of the to-be-attenuated feeder.

To ensure that an impedance of an entrance feeder of an array element after insertion of the energy attenuation circuit remains the same as that of the entrance feeder of the array element before the insertion of the energy attenuation circuit, the energy attenuation circuit needs to be a symmetric resistive attenuator, that is, a resistance of an input end of the attenuator is equal to a resistance of an output end of the attenuator. In addition, to prevent signal reflection and a standing wave, both an input equivalent impedance and an output equivalent impedance of the attenuator are equal to the characteristic impedance of the to-be-attenuated feeder.

The symmetric resistive attenuator provided in this example of this disclosure may be any one of the following:

a T-type resistive attenuator, a π-type resistive attenuator, or a bridged T-type resistive attenuator.

When the antenna includes multiple symmetric resistive attenuators, the symmetric resistive attenuators may be same resistive attenuators, or may be different resistive attenuators. For example, a T-type resistive attenuator may be used in one attenuator, and a π-type resistive attenuator may be used in another attenuator. A specific type of a resistive attenuator used in an antenna is not specifically limited in this example of this disclosure.

The following separately describes these symmetric resistive attenuators with reference to the accompanying drawings.

Figure 9:
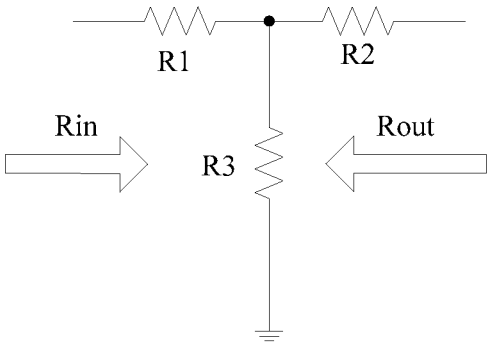
FIG. 9 is a schematic diagram of a T-type resistive attenuator according to an example of this disclosure.

Referring to FIG. 9, this figure is a schematic diagram of a T-type resistive attenuator according to an example of this disclosure.

The T-type resistive attenuator includes: a first resistor R1, a second resistor R2, and a third resistor R3.

A first end of the first resistor R1 is a first end of the energy attenuation circuit, a second end of the first resistor R1 is connected to a first end of the second resistor R2, a second end of the second resistor R2 is a second end of the energy attenuation circuit, a first end of the third resistor R3 is connected to the second end of the first resistor R1, and a second end of the third resistor R3 is a third end of the energy attenuation circuit.

Resistances of the first resistor R1, the second resistor R2, and the third resistor R3 are respectively:

$$R1 = R2 = \frac{1+A}{1-A}R - R3; \text{ and}$$

$$R3 = \frac{2R\sqrt{A}}{1-A};$$

where R1 is a resistance of the first resistor, R2 is a resistance of the second resistor, R3 is a resistance of the third resistor, A is an energy attenuation coefficient, and R is a characteristic impedance of the to-be-attenuated feeder. A is a ratio of attenuated energy to original energy. For example, if the original energy is 2, and the attenuated energy is 1, A=½. If the original energy is 3, and the attenuated energy is 2, A=⅔.

To ensure that a characteristic impedance of the original antenna remains unchanged after the insertion of the energy attenuation circuit, both the input equivalent impedance and the output equivalent impedance of the energy attenuation circuit can only be designed to be equal to the characteristic impedance. That is, as shown in FIG. 9, the input equivalent impedance Rin and the output equivalent impedance Rout of the T-type resistive attenuator are equal, and are both equal to the characteristic impedance.

FIG. 2 is still used as an example. If energy of the array elements at the four corners is attenuated to ½ of the original, 3 dB is correspondingly attenuated, A=½, and the characteristic impedance is 75Ω, that is, Rin=Rout=75Ω. It may be concluded that for the T-type resistive attenuator shown in FIG. 9, Rin is obtained after R2 and R3 are connected in parallel and then connected to R1 in series, and Rout is obtained after R1 and R3 are connected in parallel and then connected to R2 in series. Therefore, the foregoing formulas for calculating R1, R2, and R3 may be obtained. A=½ and R=75 are substituted into the foregoing formulas, to obtain R1=R2=12.8Ω and R3=213.1Ω.

Figure 10:
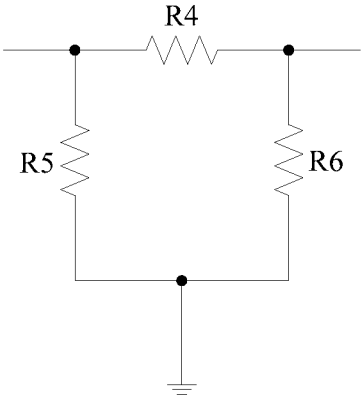
FIG. 10 is a schematic diagram of a π-type resistive attenuator according to an example of this disclosure.

Referring to FIG. 10, this figure is a schematic diagram of a π-type resistive attenuator according to an example of this disclosure.

The π-type resistive attenuator includes a fourth resistor R4, a fifth resistor R5, and a sixth resistor R6.

A first end of the fourth resistor R4 is a first end of the energy attenuation circuit, a second end of the fourth resistor R4 is a second end of the energy attenuation circuit, a first end of the fifth resistor R5 is connected to the first end of the fourth resistor R4, a second end of the fifth resistor R5 is connected to a third end of the energy attenuation circuit, a first end of the sixth resistor R6 is connected to the second end of the energy attenuation circuit, and a second end of the sixth resistor R6 is the third end of the energy attenuation circuit.

Resistances of the fourth resistor R4, the fifth resistor R5, and the sixth resistor R6 are respectively:

$$R4 = \frac{R(A*A-1)}{2A}; \text{ and}$$

$$R5 = R6 = \frac{R(1+A)}{A-1};$$

where R4 is a resistance of the fourth resistor, R5 is a resistance of the fifth resistor, R6 is a resistance of the sixth resistor, A is an energy attenuation coefficient, and R is a characteristic impedance.

Figure 11:
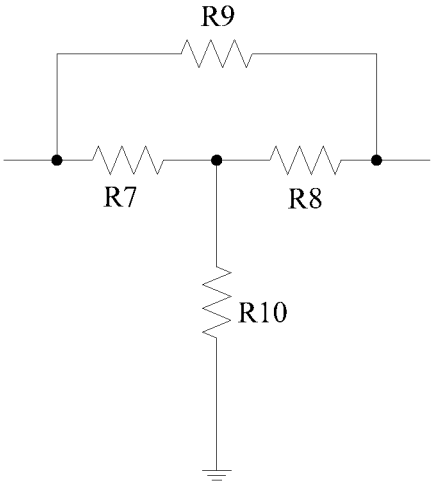
FIG. 11 is a schematic diagram of a bridged T-type resistive attenuator according to an example of this disclosure.

Referring to FIG. 11, this figure is a schematic diagram of a bridged T-type resistive attenuator according to an example of this disclosure.

The bridged T-type resistive attenuator includes a seventh resistor, an eighth resistor, a ninth resistor, and a tenth resistor.

A first end of the seventh resistor is a first end of the energy attenuation circuit, a second end of the seventh resistor is connected to a first end of the eighth resistor, a second end of the eighth resistor is a second end of the energy attenuation circuit, two ends of the ninth resistor are respectively connected to the first end and the second end of the energy attenuation circuit, a first end of the tenth resistor is connected to the first end of the seventh resistor, and a second end of the tenth resistor is a third end of the energy attenuation circuit; and $$R10 = \frac{R}{A-1};$$

$$R9 = R(A-1); \text{ and}$$

$$R7 = R8 = R;$$

where R7 is a resistance of the seventh resistor, R8 is a resistance of the eighth resistor, R9 is a resistance of the ninth resistor, R10 is a resistance of the tenth resistor, A is an energy attenuation coefficient, and R is a characteristic impedance.

Calculation principles for the resistors in the π-type resistive attenuator and the bridged T-type resistive attenuator are similar to those for the T-type resistive attenuator. Details are not described herein again.

Based on the antenna provided in the foregoing examples, an example of this disclosure further provides a communications device. The following gives a detailed description according to the accompanying drawings.

Figure 12:
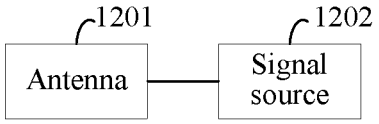
FIG. 12 is a schematic diagram of a communications device according to an example of this disclosure.

Referring to FIG. 12, this figure is a schematic diagram of a communications device according to this disclosure.

The communications device provided in this example includes an antenna 1201 described in the foregoing examples, and further includes a signal source 1202.

The signal source 1202 is connected to a cable feeding port of the antenna 1201.

The signal source 1202 may generate a radio signal, the signal source 1202 transmits a radio signal by using the antenna 1201, and the signal source 1202 may also receive a radio signal received by the antenna 1201. The signal source 1202 is connected to the antenna 1201 by using the cable feeding port, and radio signal transmission is implemented by using the cable feeding port.

The signal source 1202 is configured to send and receive the radio signal by using the antenna 1201.

For example, the signal source 1202 may be a transmitter.

Because the antenna is simple in design, and has a relatively high side lobe suppression ratio, the communications device using the antenna can keep good signal communication quality.

This disclosure provides an antenna and a communications device, so as to increase a side lobe suppression ratio of the antenna.

According to a first aspect, an antenna is provided, including: multiple feeders, a microstrip antenna array, and at least one energy attenuation circuit; the microstrip antenna array includes multiple array elements, where each of the multiple array elements is connected to a cable feeding port by using one of the multiple feeders; each of the at least one energy attenuation circuit is located at a to-be-attenuated feeder and divides the to-be-attenuated feeder into two segments, where the to-be-attenuated feeder is a feeder that is of the multiple feeders and that is connected to a to-be-attenuated array element, and the to-be-attenuated array element is an array element located at a periphery of the multiple array elements; a first end of the energy attenuation circuit is connected to the cable feeding port by using one segment of the to-be-attenuated feeder, a second end of the energy attenuation circuit is connected to the to-be-attenuated array element by using the other segment of the to-be-attenuated feeder, and a third end of the energy attenuation circuit is grounded; and the energy attenuation circuit includes a resistor, where the resistor is grounded, and the resistor is configured to consume a part of energy in the to-be attenuated feeder in a grounded manner.

Because the energy attenuation circuit consumes the energy in the grounded manner, energy transmitted to the array element located at a periphery of the antenna array is reduced, thereby implementing unbalanced energy distribution and increasing a side lobe suppression ratio.

Optionally, both an input equivalent impedance and an output equivalent impedance of the energy attenuation circuit are equal to a characteristic impedance of the to-be-attenuated feeder, so that the inserted energy attenuation circuit does not cause a standing wave.

In a first possible implementation of the first aspect, the multiple array elements are arranged into an N*1 array, peripheral array elements of the multiple array elements are two array elements located at ends of the N*1 array, and each of the two array elements corresponds to one of the at least one energy attenuation circuit, where N is an integer greater than or equal to 3.

With reference to any one of the first aspect or the foregoing possible implementation, in a second possible implementation, the multiple array elements are arranged into an N*M array, peripheral array elements of the multiple array elements are four array elements located at corners of the N*M array, and each of the four array elements corresponds to one of the at least one energy attenuation circuit, where both N and M are integers greater than or equal to 2, and at least one of N or M is greater than or equal to 3.

With reference to any one of the first aspect or the foregoing possible implementations, in a third possible implementation, each of the at least one energy attenuation circuit is a symmetric resistive attenuator.

With reference to any one of the first aspect or the foregoing possible implementations, in a fourth possible implementation, the symmetric resistive attenuator is any one of the following:

a T-type resistive attenuator, a π-type resistive attenuator, or a bridged T-type resistive attenuator.

With reference to any one of the first aspect or the foregoing possible implementations, in a fifth possible implementation, the T-type resistive attenuator includes: a first resistor, a second resistor, and a third resistor, where a first end of the first resistor is a first end of the energy attenuation circuit, a second end of the first resistor is connected to a first end of the second resistor, a second end of the second resistor is a second end of the energy attenuation circuit, a first end of the third resistor is connected to the second end of the first resistor, and a second end of the third resistor is a third end of the energy attenuation circuit; and resistances of the first resistor, the second resistor, and the third resistor are respectively:

$$R1 = R2 = \frac{1+A}{1-A}R - R3; \text{ and}$$

$$R3 = \frac{2R\sqrt{A}}{1-A};$$

where R1 is the resistance of the first resistor, R2 is the resistance of the second resistor, R3 is the resistance of the third resistor, A is an energy attenuation coefficient, and R is a characteristic impedance of the to-be-attenuated feeder.

With reference to any one of the first aspect or the foregoing possible implementations, in a sixth possible implementation, the π-type resistive attenuator includes a fourth resistor, a fifth resistor, and a sixth resistor, where a first end of the fourth resistor is a first end of the energy attenuation circuit, a second end of the fourth resistor is a second end of the energy attenuation circuit, a first end of the fifth resistor is connected to the first end of the fourth resistor, a second end of the fifth resistor is connected to a third end of the energy attenuation circuit, a first end of the sixth resistor is connected to the second end of the energy attenuation circuit, and a second end of the sixth resistor is the third end of the energy attenuation circuit; and resistances of the fourth resistor, the fifth resistor, and the sixth resistor are respectively:

$$R4 = \frac{R(A * A - 1)}{2A}; \text{ and}$$

$$R5 = R6 = \frac{R(1 + A)}{A - 1};$$

where R4 is the resistance of the fourth resistor, R5 is the resistance of the fifth resistor, R6 is the resistance of the sixth resistor, A is the energy attenuation coefficient, and R is the characteristic impedance.

With reference to any one of the first aspect or the foregoing possible implementations, in a seventh possible implementation, the bridged T-type resistive attenuator includes a seventh resistor, an eighth resistor, a ninth resistor, and a tenth resistor, where a first end of the seventh resistor is a first end of the energy attenuation circuit, a second end of the seventh resistor is connected to a first end of the eighth resistor, a second end of the eighth resistor is a second end of the energy attenuation circuit, two ends of the ninth resistor are respectively connected to the first end and the second end of the energy attenuation circuit, a first end of the tenth resistor is connected to the first end of the seventh resistor, and a second end of the tenth resistor is a third end of the energy attenuation circuit; and $$R10 = \frac{R}{A - 1};$$

$$R9 = R(A - 1); \text{ and}$$

$$R7 = R8 = R;$$

where R7 is a resistance of the seventh resistor, R8 is a resistance of the eighth resistor, R9 is a resistance of the ninth resistor, R10 is a resistance of the tenth resistor, A is the energy attenuation coefficient, and R is the characteristic impedance.

In the fifth to the seventh possible implementations of the first aspect, the resistances of the resistors calculated according to the formulas make both the input equivalent impedance and the output equivalent impedance of the energy attenuation circuit equal to the characteristic impedance of the to-be-attenuated feeder. Therefore, the inserted energy attenuation circuit does not cause a standing wave.

With reference to any one of the first aspect or the foregoing possible implementations, in an eighth possible implementation, the feeders in the antenna are feeders corresponding to balanced energy distribution between the array elements.

The antenna is an improvement made based on the balanced energy distribution between the array elements in the original antenna, and the energy attenuation circuit is inserted into the feeder connected to the array element located at a periphery of the antenna array. The side lobe suppression ratio of the antenna can be increased by directly inserting the energy attenuation circuit based on the original antenna. In this way, new feeders do not need to be designed, thereby reducing design difficulty.

According to a second aspect, a communications device is provided, including the antenna, and further including a signal source; the signal source is connected to a feeding port of the antenna; and the signal source is configured to use the antenna to send and receive a radio signal.

In conclusion, the foregoing examples are merely intended for describing the technical solutions of this disclosure, rather than limiting this disclosure. Although this disclosure is described in detail with reference to the foregoing examples, a person of ordinary skill in the art should understand that modifications may still be made to the technical solutions described in the foregoing examples without departing from the scope of the technical solutions of the examples of this disclosure.

What is claimed is:

1. An antenna comprising:

a cable feeding port;

a plurality of feeders comprising a first feeder;

a microstrip antenna array comprising a plurality of array elements, wherein each of the array elements is connected to the cable feeding port using one of the feeders, wherein the array elements comprise a first array element located at a periphery of the array elements and connected to the first feeder, wherein the first feeder is an entrance feeder of the first array element so that the first feeder is connected to the first array element, but no other array elements; and a first energy attenuation circuit located at the first feeder, dividing the first feeder into a first segment and a second segment, and comprising:

a first end connected to the cable feeding port using the first segment;

a second end connected to the first array element using the second segment;

a third end configured to connect to a ground; and a resistor configured to consume a part of an energy in the first feeder when the resistor is grounded.

2. The antenna of claim 1, further comprising a second energy attenuation circuit, wherein the array elements are arranged into an N×1 array, wherein the array elements further comprise a second array element, wherein the first array element and the second array element are located at ends of the N×1 array, wherein the first array element corresponds to the first energy attenuation circuit, wherein the second array element corresponds to the second energy attenuation circuit, and wherein N is an integer that is greater than or equal to 3.

3. The antenna of claim 1, further comprising a second energy attenuation circuit, a third energy attenuation circuit, and a fourth energy attenuation circuit, wherein the array elements are arranged into an N×M array, wherein the array elements further comprise a second array element, a third array element, and a fourth array element, wherein the first array element, the second array element, the third array element, and the fourth array element are located at corners of the N×M array, wherein the first array element corresponds to the first energy attenuation circuit, wherein the second array element corresponds to the second energy attenuation circuit, wherein the third array element corresponds to the third energy attenuation circuit, wherein the fourth array element corresponds to the fourth energy attenuation circuit, and wherein both N and M are integers that are greater than or equal to 2.

4. The antenna of claim 1, wherein the first energy attenuation circuit is a symmetric resistive attenuator.

5. The antenna according to claim 4, wherein the symmetric resistive attenuator is a T-type resistive attenuator, a π-type resistive attenuator, or a bridged T-type resistive attenuator.

6. The antenna of claim 5, wherein the T-type resistive attenuator comprises the resistor, wherein the resistor comprises a first resistor, a second resistor, and a third resistor, wherein a first end of the first resistor is connected to the first end of the first energy attenuation circuit, wherein a second end of the first resistor is connected to a first end of the second resistor, wherein a second end of the second resistor is connected to the second end of the first energy attenuation circuit, wherein a first end of the third resistor is connected to the second end of the first resistor, wherein a second end of the third resistor is connected to the third end of the first energy attenuation circuit, wherein resistances of the first resistor, the second resistor, and the third resistor are:

$$R1 = R2 = \frac{1+A}{1-A}R - R3, \text{ and}$$

$$R3 = \frac{2R\sqrt{A}}{1-A},$$

wherein R1 is a first resistance of the first resistor, wherein R2 is a second resistance of the second resistor, wherein R3 is a third resistance of the third resistor, wherein A is an energy attenuation coefficient, and wherein R is a characteristic impedance of the first feeder.

7. The antenna of claim 5, wherein the π-type resistive attenuator comprises the resistor, wherein the resistor comprises a fourth resistor, a fifth resistor, and a sixth resistor, wherein a first end of the fourth resistor is connected to the first end of the first energy attenuation circuit, wherein a second end of the fourth resistor is connected to a second end of the first energy attenuation circuit, wherein a first end of the fifth resistor is connected to the first end of the fourth resistor, wherein a second end of the fifth resistor is connected to the third end of the first energy attenuation circuit, wherein a first end of the sixth resistor is connected to the second end of the first energy attenuation circuit, wherein a second end of the sixth resistor is connected to the third end of the first energy attenuation circuit, wherein resistances of the fourth resistor, the fifth resistor, and the sixth resistor are:

$$R4 = \frac{R(A*A-1)}{2A}, \text{ and}$$

$$R5 = R6 = \frac{R(1+A)}{A-1},$$

wherein R4 is a fourth resistance of the fourth resistor, wherein R5 is a fifth resistance of the fifth resistor, wherein R6 is a sixth resistance of the sixth resistor, wherein A is an energy attenuation coefficient, and wherein R is a characteristic impedance.

8. The antenna of claim 5, wherein the bridged T-type resistive attenuator comprises the resistor, wherein the resistor comprises a seventh resistor, an eighth resistor, a ninth resistor, and a tenth resistor, wherein a first end of the seventh resistor is connected to the first end of the first energy attenuation circuit, wherein a second end of the seventh resistor is connected to a first end of the eighth resistor, wherein a second end of the eighth resistor is connected to the second end of the first energy attenuation circuit, wherein two ends of the ninth resistor are connected to the first end and the second end of the first energy attenuation circuit, wherein a first end of the tenth resistor is connected to the second end of the seventh resistor, wherein a second end of the tenth resistor is connected to the third end of the first energy attenuation circuit, wherein resistances of the seventh resistor, the eighth resistor, the ninth resistor and the tenth resistor are:

$$R10 = \frac{R}{A-1},$$

$$R9 = R(A-1), \text{ and}$$

$$R7 = R8 = R,$$

wherein R7 is a seventh resistance of the seventh resistor, wherein R8 is an eighth resistance of the eighth resistor, wherein R9 is a ninth resistance of the ninth resistor, wherein R10 is a tenth resistance of the tenth resistor, wherein A is an energy attenuation coefficient, and wherein R is a characteristic impedance.

9. The antenna of claim 1, wherein the feeders are configured to provide a balanced energy distribution among the array elements.

10. The antenna of claim 1, wherein the first array element is configured to transmit and receive signals.

11. A communications device comprising:

an antenna comprising:

a cable feeding port;

a plurality of feeders comprising a first feeder;

a microstrip antenna array comprising a plurality of array elements, wherein each of the array elements is connected to the cable feeding port using one of the feeders, wherein the array elements comprise a first array element located at a periphery of the array elements and connected to the first feeder, wherein the first feeder is an entrance feeder of the first array element so that the first feeder is connected to the first array element, but no other array elements; and a first energy attenuation circuit located at the first feeder, dividing the first feeder into a first segment and a second segment, and comprising:

a first end connected to the cable feeding port using the first segment;

a second end connected to the first array element using the second segment;

a third end configured to connect to a ground; and a resistor configured to consume a part of an energy in the first feeder when the resistor is grounded; and a signal source connected to the cable feeding port and configured to use the antenna to send and receive a radio signal.

12. The communications device of claim 11, wherein the antenna further comprises a second energy attenuation circuit, wherein the array elements are arranged into an N×1 array, wherein the array elements further comprise a second array element, wherein the first array element and the second array element are located at ends of the N×1 array, wherein the first array element corresponds to the first energy attenuation circuit, wherein the second array element corresponds to the second energy attenuation circuit, and wherein N is an integer that is greater than or equal to 3.

13. The communications device of claim 11, wherein the antenna further comprises a second energy attenuation circuit, a third energy attenuation circuit, and a fourth energy attenuation circuit, wherein the array elements are arranged into an N×M array, wherein the array elements further comprise a second array element, a third array element, and a fourth array element, wherein the first array element, the second array element, the third array element, and the fourth array element are located at corners of the N×M array, wherein the first array element corresponds to the first energy attenuation circuit, wherein the second array element corresponds to the second energy attenuation circuit, wherein the third array element corresponds to the third energy attenuation circuit, wherein the fourth array element corresponds to the fourth energy attenuation circuit, and wherein both N and M are integers that are greater than or equal to 2.

14. The communications device of claim 11, wherein the first energy attenuation circuit is a symmetric resistive attenuator.

15. The communications device of claim 14, wherein the symmetric resistive attenuator is a T-type resistive attenuator, a π-type resistive attenuator, or a bridged T-type resistive attenuator.

16. The communications device of claim 11, wherein the feeders are configured to provide a balanced energy distribution among the array elements.

17. The communications device of claim 11, wherein the first array element is configured to transmit and receive signals.

18. A method of making an antenna, the method comprising:

forming a microstrip antenna array comprising a plurality of array elements;

connecting each of the array elements to a cable feeding port using one of a plurality of feeders, wherein the array elements comprise a first array element, and wherein the feeders comprise a first feeder;

locating the first array element at a periphery of the array elements;

connecting the first array element to the first feeder, wherein the first feeder is an entrance feeder of the first array element so that the first feeder is connected to the first array element, but no other array elements;

providing a first energy attenuation circuit;

locating the first energy attenuation circuit at the first feeder such that the first energy attenuation circuit divides the first feeder into a first segment and a second segment;

connecting a first end of the first energy attenuation circuit to the cable feeding port using the first segment;

connecting a second end of the first energy attenuation circuit to the first array element using the second segment;

connecting a third end of the first energy attenuation circuit to a ground; and providing a resistor of the energy attenuation circuit such that the resistor consumes a part of an energy in the first feeder when the resistor is grounded.

19. The method of claim 18, further comprising:

arranging the array elements into an N×1 array, wherein the array elements further comprise a second array element; and locating the first array element and the second array element at ends of the N×1 array, wherein the first array element corresponds to the first energy attenuation circuit and the second array element corresponds to a second energy attenuation circuit, and wherein N is an integer that is greater than or equal to 3.

20. The method of claim 18, further comprising:

arranging the array elements into an N×M array, wherein the array elements comprise a second array element, a third array element, and a fourth array element; and locating the first array element, the second array element, the third array element, and the fourth array element at corners of the N×M array, wherein the first array element corresponds to the first energy attenuation circuit, the second array element corresponds to a second energy attenuation circuit, the third array element corresponds to a third energy attenuation circuit, and the fourth array element corresponds to a fourth energy attenuation circuit, and wherein both N and M are integers that are greater than or equal to 2.

21. The method of claim 18, wherein the first energy attenuation circuit is a symmetric resistive attenuator.

22. The method of claim 18, further comprising providing, by the feeders, a balanced energy distribution among the array elements.

23. The method of claim 18, wherein the first array element is configured to transmit and receive signals.

* * * * *